US007680442B2

(12) United States Patent
Muramoto et al.

(10) Patent No.: US 7,680,442 B2
(45) Date of Patent: Mar. 16, 2010

(54) POWDER STIRRING DEVICE, DEVELOPING DEVICE, AND IMAGE FORMING APPARATUS INCORPORATING THE SAME

(75) Inventors: Hideya Muramoto, Osaka (JP); Satoshi Uemura, Osaka (JP); Tomohiko Kubo, Kobe (JP); Takahiko Murata, Osaka (JP)

(73) Assignee: Kyocera Mita Corporation (JP)

( * ) Notice: Subject to any disclaimer, the term of this patent is extended or adjusted under 35 U.S.C. 154(b) by 129 days.

(21) Appl. No.: 11/904,073

(22) Filed: Sep. 26, 2007

(65) Prior Publication Data

US 2008/0267667 A1 Oct. 30, 2008

(30) Foreign Application Priority Data

Sep. 29, 2006 (JP) ..... 2006-269227

(51) Int. Cl.
*G03G 15/08* (2006.01)

(52) U.S. Cl. ..... 399/254; 222/DIG. 1

(58) Field of Classification Search ..... 399/254, 399/256, 258; 222/DIG. 1; 366/292, 342, 366/343

See application file for complete search history.

(56) References Cited

U.S. PATENT DOCUMENTS 6,456,810 B1 * 9/2002 Deguchi et al. ..... 399/254
6,526,245 B1 * 2/2003 Yamashita ..... 399/254
7,079,793 B2 7/2006 Amano et al.
2007/0196135 A1 * 8/2007 Fukuta ..... 399/254

FOREIGN PATENT DOCUMENTS

| | | | |
|---|---|---|---|
| CN | 1629746 | | 6/2005 |
| JP | 10-069166 A | * | 3/1998 |
| JP | 11-24401 | | 1/1999 |
| JP | 11-311895 | | 11/1999 |
| JP | 2001-100500 | | 4/2001 |
| JP | 2002-236410 | | 8/2002 |

* cited by examiner

*Primary Examiner*—Sophia S Chen
(74) *Attorney, Agent, or Firm*—Gerald E. Hespos; Anthony J. Casella

(57) ABSTRACT

A developing device includes a developing container that accommodates toner particles, a developing roller that supplies the toner particles to an image carrier on which an electrostatic latent image is formed, and a stirring and transporting member that transports the toner particles inside the developing container toward the developing roller with stirring by rotating around a shaft axis. The stirring and transporting member includes a shaft portion serving as a rotation center and sheet-shaped first stirring blade and second stirring blade fixed to the shaft portion so as to extend outward in a radius direction from the shaft portion. The first stirring blade transports the toner particles in a first transportation direction. The second stirring blade transports the toner particles in a second transportation direction different from the first transportation direction.

17 Claims, 10 Drawing Sheets

POWDER STIRRING DEVICE, DEVELOPING DEVICE, AND IMAGE FORMING APPARATUS INCORPORATING THE SAME

BACKGROUND OF THE INVENTION

1. Field of the Invention

The present invention relates to an electrophotographic image forming apparatus represented by a copying machine and a printer, and to a developing device adaptable to the image forming apparatus or a powder stirring device.

2. Description of the Related Art

In an electrophotographic image forming apparatus, such as a copying machine and a printer, a photoconductive drum is used extensively as an image carrier. A normal image forming operation with the use of the photoconductive drum is as follows. The peripheral surface of the photoconductive drum is charged uniformly to specific potential by the charging device, and an electrostatic latent image of a document image is formed on the peripheral surface of the photoconductive drum by optically attenuating the potential in part through irradiation of light to the peripheral surface from an LED or the like in the exposing device. A toner image is formed by developing the electrostatic latent image by the developing device. After the toner image is transferred onto a sheet, toner particles remaining on the peripheral surface of the photoconductive drum are cleaned by the cleaning device, and static eliminating light is irradiated to the surface from a static eliminating device for eliminating static electricity from the charged surface to prepare for the following image forming operation.

The developing device serving as a main portion of the image forming operation as described above is configured in such a manner that a specific amount of toner particles are constantly accommodated inside the developing container. When toner particles are consumed and a remaining amount becomes low, toner particles are additionally replenished. In this instance, toner particles are generally put into the developing container from a toner replenishing container disposed above the developing device by gravitational action or with the use of a transportation member.

Because the developing container accommodates the developing roller, it is normally of an elongate shape that matches the shape of the developing roller. To enable a high-quality image to be formed, it is necessary that toner particles accommodated inside the developing container are distributed homogeneously along the longitudinal direction of the developing roller inside the developing container. To this end, the developing device includes a stirring (transporting) member that rotates about the shaft axis and widely adopts a method for distributing toner particles homogeneously in the longitudinal direction inside the developing container by a rotating operation of the stirring (transporting) member.

Examples of such a developing device are described in JP-A-2001-100500 (Reference D1) and JP-A-11-311895 (Reference D2). Both the developing devices described in References D1 and D2 include a stirring (transporting) member provided with a sheet member (stirring blade) having openings therein, and transport toner particles toward the developing roller with stirring by means of the stirring (transporting) member.

The developing device described in Reference D1 is configured so as to be able to supply the developing roller with toner particles in association with rotations of the stirring and transporting member in a stable manner without experiencing large resistance by using two sheet members provided with plural openings in a staggered arrangement. With the stirring and transporting member configured in this manner, toner particles are thought to migrate in the longitudinal direction inside the developing container owing to the openings in a staggered arrangement. However, the sheet members and the openings therein are not configured in a satisfactory manner in terms of allowing the toner particles to migrate inside the developing container. It is therefore difficult to distribute the toner particles homogeneously to a satisfactory extent across the entire region in the longitudinal direction inside the developing container. Consequently, a large amount of toner particles concentrate in a region near the supplied point in the developing container, such as the toner replenishment port, and toner particles that have been left unused over a considerable time may possibly accumulate in the opposing region. Hence, an image defect is likely to occur when such accumulated toner particles in a deteriorated condition are supplied to the developing roller.

The developing device described in Reference D2 is configured in such a manner that toner particles are gathered at the center portion in the shaft axis direction of the developing roller in association with rotations of the stirring and transporting member by sheet members provided with plural parallelogram-shaped openings. With the stirring and transporting member configured in this manner, however, a large amount of toner particles are gathered at the center portion in the shaft axis direction of the developing roller, and toner particles that have been left unused over a considerable time may possibly accumulate at the both ends. Hence, an image defect is likely to occur at the both ends of the developing roller when such accumulated toner particles in a deteriorated condition are supplied to the developing roller.

SUMMARY OF THE INVENTION

An object of the invention is to provide a developing device capable of forming a high-quality image by distributing toner particles homogeneously to a satisfactory extent in the longitudinal direction inside the developing container even when toner particles are replenished to the developing container locally. Also, another object of the invention is to provide a high-performance image forming apparatus incorporating such a developing device.

A developing device in an aspect of the invention to achieve the above and other objects includes a developing container that accommodates toner particles, a developing roller that supplies the toner particles to an image carrier on which an electrostatic latent image is formed, and a stirring and transporting member that transports the toner particles inside the developing container toward the developing roller with stirring by rotating around a shaft axis, wherein the stirring and transporting member includes a shaft portion serving as a rotation center and sheet-shaped first stirring blade and second stirring blade fixed to the shaft portion so as to extend outward in a radius direction from the shaft portion, and the first stirring blade transports the toner particles in a first transportation direction and the second stirring blade transports the toner particles in a second transportation direction different from the first transportation direction.

An image forming apparatus in another aspect of the invention includes an image carrier on which an electrostatic latent image is formed and a developing device that supplies the image carrier with toner particles, wherein the developing device has the configuration as described above.

DETAILED DESCRIPTION OF THE PREFERRED EMBODIMENTS

Hereinafter, embodiments of the invention will be described with reference to FIG. 1 through FIG. 14.

Figure 1:
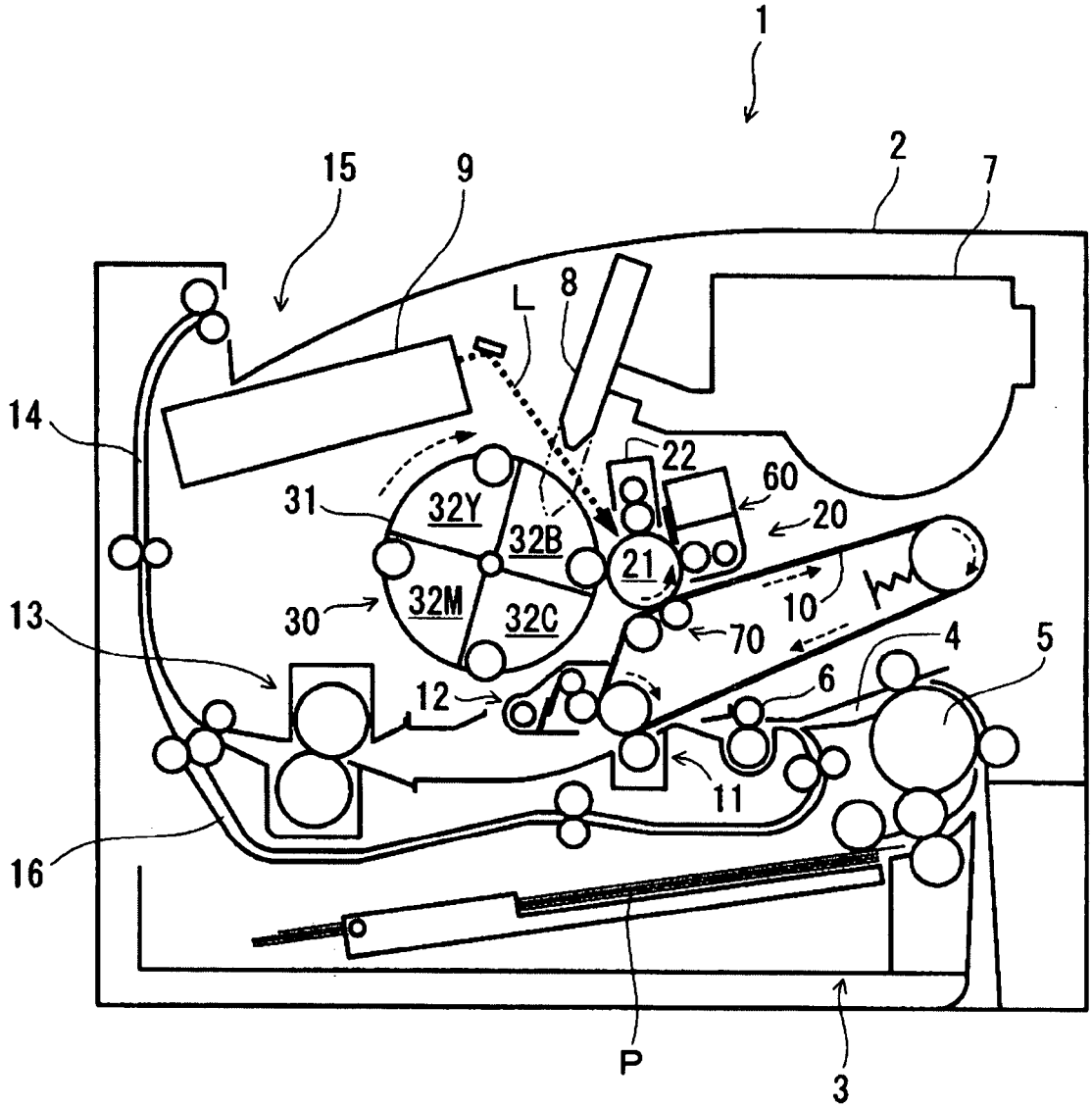
FIG. 1 is a vertical cross section of a printer incorporating a developing device according to a first embodiment of the invention.

An image forming apparatus incorporating a developing device according to a first embodiment of the invention will be described first using FIG. 1 as to the schematic configuration thereof. FIG. 1 is a vertical cross section schematically showing the configuration of a color printer 1 as an example of the image forming apparatus. The color printer 1 is of a type using an intermediate transfer belt. In FIG. 1, the right side and the left side are the front side and the rear side of the printer 1, respectively.

A sheet cassette 3 is disposed inside a main body 2 of the printer 1 at the bottom thereof. Sheets P are stacked and accommodated in the sheet cassette 3. The sheets P are fed toward the upper right of the sheet cassette 3 in FIG. 1. The sheet cassette 3 can be pulled out in a horizontal posture from the front of the main body 2, that is, from the right in FIG. 1.

A sheet transportation path 4 for feeding, a sheet feeding transportation roller 5, a registration roller 6, and an image forming portion 20 are disposed downstream of the sheet cassette 3 in the sheet transportation direction. The image forming portion 20 includes a photoconductive drum 21, which is an image carrier formed of a rotating body, at the center thereof. The photoconductive drum 21 rotates in a counterclockwise direction in FIG. 1. A charging device 22, a developing device 30, and a drum cleaning device 60 are disposed sequentially on the periphery of the photoconductive drum 21 along the rotation direction thereof.

The developing device 30 has a main portion formed of a rotary rack 31 that rotates in a clockwise direction in FIG. 1, and a total of four developers 32 are disposed in the rotary rack 31 at regular intervals in the circumferential direction. The four developers 32 are a developer 32B for black, a developer 32Y for yellow, a developer 32M for magenta, and a developer 32C for cyan.

The rotary rack 31 is rotated by an unillustrated driving mechanism, and forms a toner image by supplying toner particles as developing agents in respective colors to the peripheral surface of the photoconductive drum 21 by moving the four developers 32 successively to the position opposing the photoconductive drum 21. Toner replenishing containers 7 and replenishing pipes 8 to replenish the developing device 30 with toner particles are provided above the image forming portion 20. The toner replenishing containers 7 and the replenishing pipes 8 for the respective colors are disposed side by side in the shaft axis direction of the rotary rack 31.

An optical portion 9 is provided above the image forming portion 20. A laser beam L is irradiated toward the photoconductive drum 21 from the optical portion 9. A dotted line in the drawing represents the laser beam L.

An intermediate transfer belt 10, which is an intermediate transfer body in the form of an endless belt, is disposed beneath the photoconductive drum 21. The intermediate transfer belt 10 is stretched over plural rollers and supported thereon to rotate in a clockwise direction in FIG. 1. The intermediate transfer belt 10 is pressed against the photoconductive drum 21 from below and forms a primary transfer portion 70.

A secondary transfer portion 11 is disposed at a point at which the intermediate transfer belt 10 lies over the sheet transportation path 4. A sheet P is pressed against the intermediate transfer belt 10 as it is inserted through a secondary transfer nip portion formed in the secondary transfer portion 11, and a toner image is transferred thereon. A belt cleaning portion 12 is provided downstream of the secondary transfer portion 11 in the sheet transportation direction.

A fixing portion 13, a sheet transportation path 14 for discharging, and a sheet discharging portion 15 are disposed downstream of the image forming portion 20 and the secondary transfer portion 11 in the sheet transportation direction. The sheet discharging portion 15 is provided on top of the main body 2 at a position at which the user is able to pick up printed sheets P from the outside.

A sheet transportation path 16 for duplex printing is disposed below the fixing portion 13 and the secondary transfer portion 11 and above the sheet cassette 3. The sheet transportation path 16 for duplex printing branches from the sheet transportation path 14 for discharging somewhere in the middle, and passes under the fixing portion 13 and the secondary transfer portion 11 to merge with the sheet transportation path 4 for feeding immediately upstream of the registration roller 6.

Figure 2:
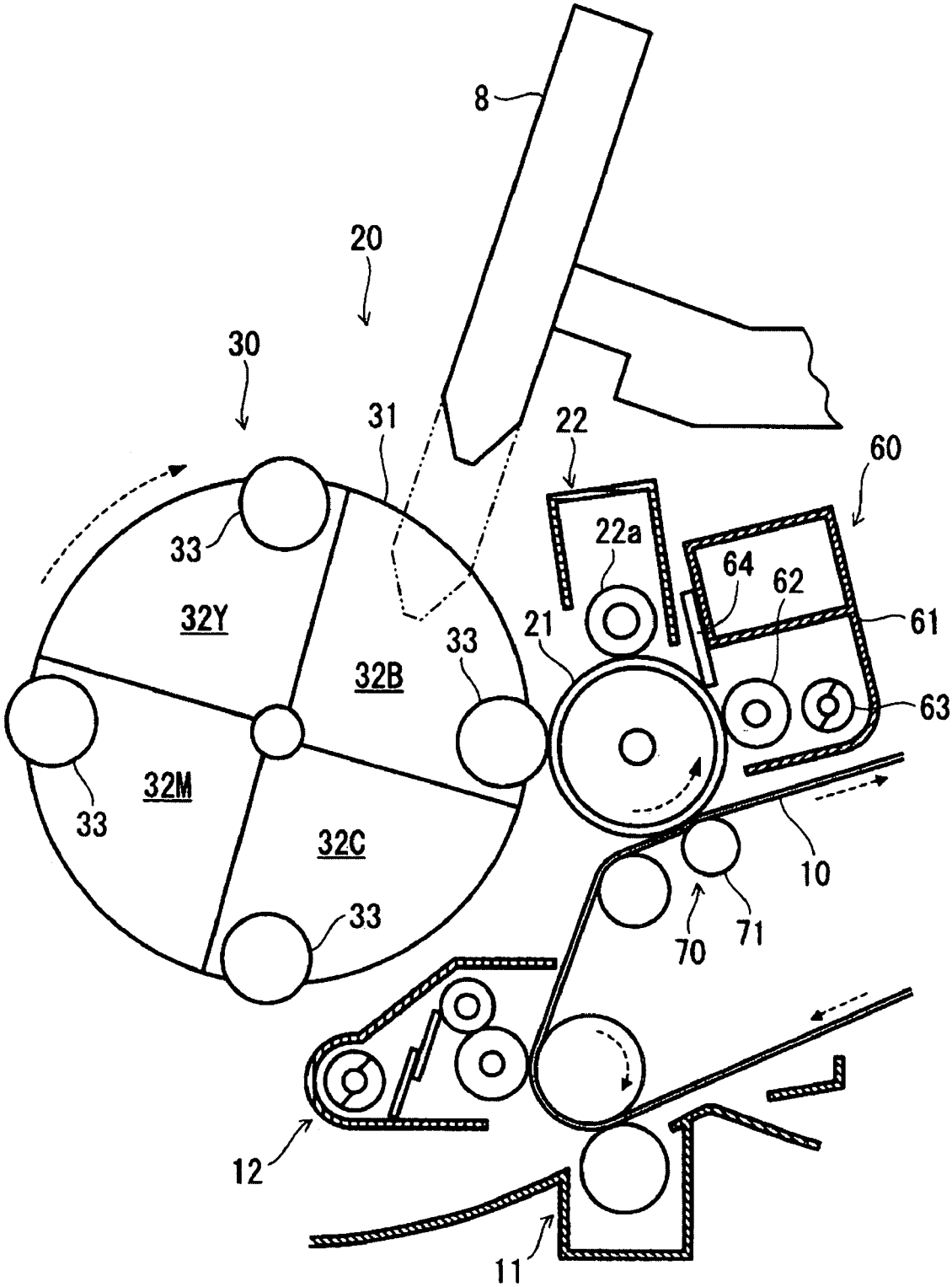
FIG. 2 a partially enlarged view showing the vicinity of an image forming portion of FIG. 1.

The configuration in the vicinity of the image forming portion 20 in the printer 1 will now be described more in detail using FIG. 2. FIG. 2 is a partially enlarged view of a vertical cross section showing the vicinity of the image forming portion.

The image forming portion 20 includes the photoconductive drum 21 serving as an image carrier at the center thereof. As has been described above, the charging device 22, the developing device 30, and the drum cleaning device 60 are disposed sequentially in the vicinity of the photoconductive drum 21 along the rotation direction thereof. The primary transfer portion 70 at which the intermediate transfer belt 10 is pressed against the photoconductive drum 21 is provided between the developing device 30 and the drum cleaning device 60 along the rotation direction of the photoconductive drum 21.

The photoconductive drum 21 extends in the sheet width direction orthogonal to the sheet transportation direction inside the printer 1, that is, in the depth direction on the sheet surface of FIG. 2, and it is disposed by aligning the shaft axis direction horizontally. The photoconductive drum 21 is a drum having a diameter of 30 mm and made of an inorganic photoconductor formed by providing a photoconductive layer made of amorphous silicon, which is an inorganic photoconductive material, on the outer periphery of a roller-shaped conductive base made of aluminum or the like by means of vacuum evaporation or the like. The photoconductive drum 21 is rotated by an unillustrated driving device at a circumferential velocity almost as high as a sheet transportation velocity (for example, 210 mm/sec).

The charging device 22 includes inside a charging roller 22*a* that comes into contact with the photoconductive drum 21. The charging roller 22*a* is pressed against the photoconductive drum 21 at a specific pressure and rotates as the photoconductive drum 21 rotates. The peripheral surface of the photoconductive drum 21 is charged uniformly at specific polarity and potential by the charging roller 22*a*.

As has been described above, the developing device 30 has the main portion formed of the rotary rack 31, and a total of four developers 32 are disposed in the rotary rack 31 at regular intervals in the circumferential direction. Each developer 32 is provided with a developing roller 33 in close proximity to the photoconductive drum 21. A bias of the polarity same as the polarity of static electricity of the charged photoconductive drum 21 is applied to the developing roller 33. Toner particles as the developing agents are charged by the developing roller 33, so that they migrate to the electrostatic latent image on the peripheral surface of the photoconductive drum 21 to develop the electrostatic latent image. Toner particles are accommodated in the toner replenishing containers 7 (see FIG. 1), and transported to the developing device 30 for replenishment via the replenishing pipes 8. When toner particles are replenished, the replenishing pipes 8 extend to a point indicated by a chain double-dashed line in FIG. 2. The configuration of the developing device 30 will be described more in detail below.

Toner particles used in the developing device 30 are toner particles made of a mono-component developing agent. In order to secure high fluidity during stirring and transportation, toner particles of a shape having a high circular degree are preferable. When measured by a flow particle image analyzer, FPIA, available from Sysmex Corporation, it is preferable that the average circular degree of toner particles is found to be 0.930 to 0.995. It is preferable to blend a large amount of silica having fluidity that hardly changes with time and a relatively large diameter as an extraneous additive to toner particles.

The primary transfer portion 70 is provided with a primary transfer roller 71 that comes into contact with the photoconductive drum 21 via the intermediate transfer belt 10. The primary transfer nip portion at which the photoconductive drum 21 and the intermediate transfer belt 10 come into contact with each other is formed at a point where the primary transfer roller 71 is provided. The primary transfer roller 71 has no driving device and it rotates as the intermediate transfer belt 10 rotates by coming into contact with the intermediate transfer belt 10. A primary transfer bias having a polarity opposite to the polarity of static electricity of the charged photoconductive drum 21 and toner particles is applied to the primary transfer roller 71 as needed.

The intermediate transfer belt 10 is formed of a mono-layer resin belt made of synthetic resin alone, such as polyimide, or an elastic belt formed by layering a rubber layer on the surface of such synthetic resin, and it is stretched over plural rollers and supported thereon.

The drum cleaning device 60 is disposed further downstream of the primary transfer portion 70 along the rotation direction of the photoconductive drum 21. The drum cleaning device 60 includes a cleaning roller 62 and a discharge screw 63 inside a housing 61 thereof and a cleaning blade 64 between the housing 61 and the photoconductive drum 21.

The cleaning roller 62 and the cleaning blade 64 are pushed by unillustrated elastic members, such as springs, and thereby pushed against the photoconductive drum 21. The cleaning roller 62 and the cleaning blade 64 extend in the shaft axis direction of the photoconductive drum 21 and have lengths in the shaft axis direction almost as long as the photoconductive layer of the photoconductive drum 21.

In order to perform cleaning efficiently, the cleaning roller 62 is rotated in a direction inverse to the rotation direction of the photoconductive drum 21 about the rotation shaft by an unillustrated driving device at a circumferential velocity 15 to 20% higher than the circumferential velocity of the photoconductive drum 21. Toner particles remaining on the surface of the photoconductive drum 21 are cleaned after the toner image is transferred onto the intermediate transfer belt 10 as they are removed by the cleaning roller 62 and the cleaning blade 64 configured as above. The toner particles removed from the surface of the photoconductive drum 21 are collected inside the housing 61 first, and then discharged to the outside by the discharge screw 63.

Figure 3:
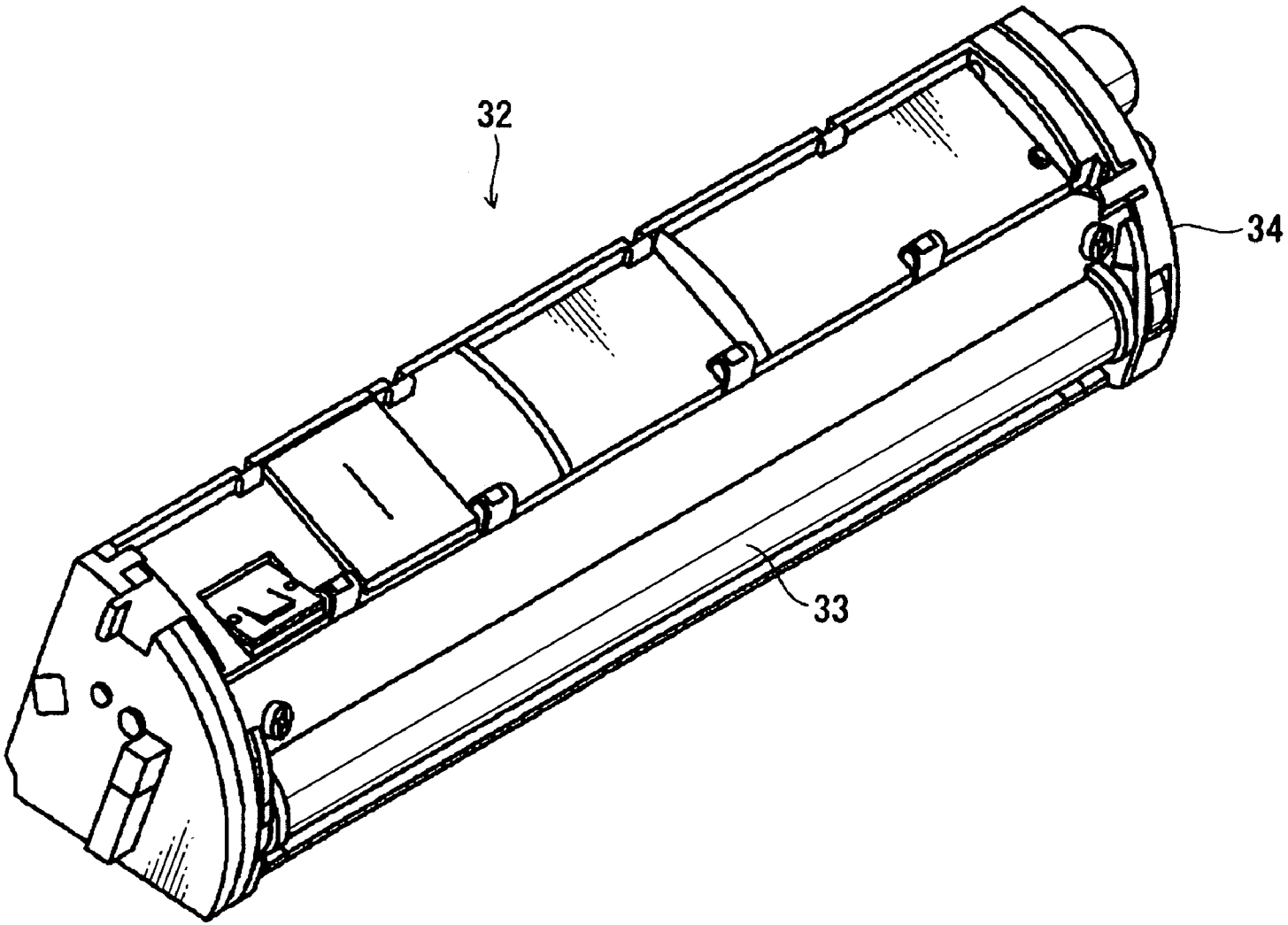
FIG. 3 is a perspective view of a developer provided to the developing device of FIG. 2.
Figure 4:
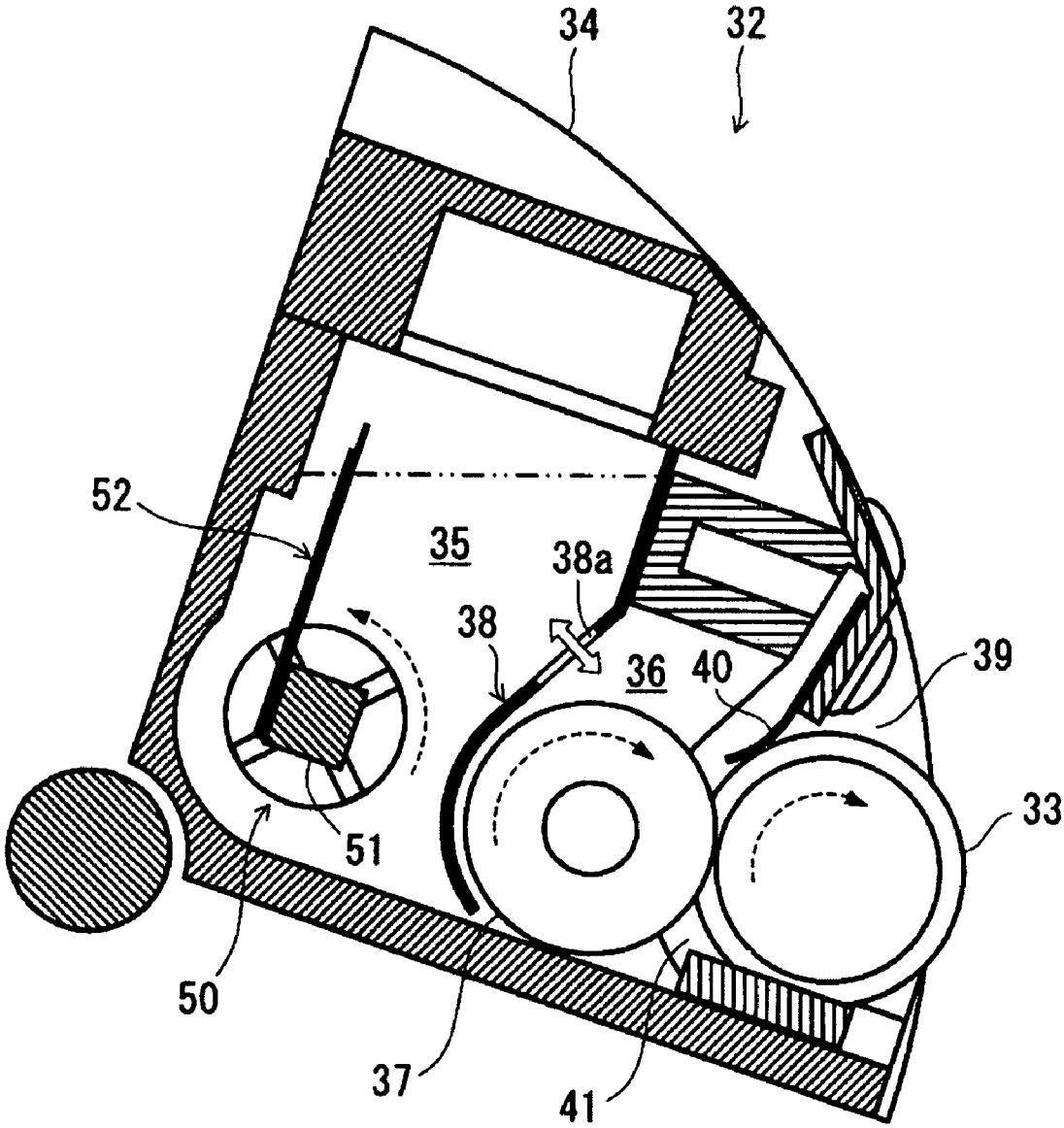
FIG. 4 is a lateral cross section of the developer shown in FIG. 3.

The configuration of the developing device 30 will now be described more in detail using FIG. 3 and FIG. 4 in addition to FIG. 2. FIG. 3 is a perspective view of a developer provided to the developing device. FIG. 4 is a lateral cross section of the developer. Because all the developers 32 for four colors have a common basic structure, capitals Y, M, C, and B representing the respective colors are omitted hereinafter.

The developing device 30 shown in FIG. 2 includes the developers 32 shown n FIG. 3, and each developer 32 includes a developing container 34. The developing container 34 is of an elongate shape in the shaft axis direction of the photoconductive drum 21, that is, in the depth direction on the sheet surface of FIG. 2, and disposed by aligning the longitudinal direction horizontally. When toner particles are replenished to the developing container 34 via the replenishing pipe 8 (see FIG. 2), toner particles are replenished from a specific local portion of the developing device 34 in the longitudinal direction.

As is shown in FIG. 4, a hopper portion 35 and a developing portion 36 are provided inside the developing container 34. The hopper portion 35 is provided with a stirring and transporting member 50 that stirs and transports toner particles and the developing portion 36 is provided with a supply roller 37 that supplies toner particles to the developing roller 33 by aligning their respective shaft axes horizontally. The configuration of the stirring and transporting member 50 will be described in detail below.

The hopper portion 35 and the developing portion 36 are divided by a partition wall 38 inside the developing container 34. The partition wall 38 is formed of a thin plate-shaped member made of metal. It extends along the longitudinal direction of the developing container 34 and includes an opening 38*a* at a point above the supply roller 37. The opening 38*a* is provided in a plural form in the longitudinal direction of the developing container 34, so that, as is indicated by an outline arrow in FIG. 4, toner particles are allowed to migrate in and out between the hopper portion 35 and the developing portion 36. The partition wall 38 configured as above makes it possible to limit an amount of toner particles migrating between the hopper portion 35 and the developing portion 36. Toner particles are normally accommodated inside the developing container 34 to a level indicated by a chain double-dashed line in FIG. 4.

The developing portion 36 includes an opening portion 39 in a portion adjacent to the photoconductive drum 21. The developing roller 33 as a developing agent carrier is disposed in the opening portion 39. One side of the developing roller 33 is located inside the developing portion 36 and the other side is exposed to the outside of the developing portion 36 to oppose the photoconductive drum 21 as the image carrier (see FIG. 2). The developing roller 33 is rotated in a clockwise direction in FIG. 4 by an unillustrated driving mechanism.

A limiting plate 40 is provided downstream of the developing roller 33 in the rotation direction from a point on the inner side of the developing portion 36, that is, above the developing roller 33 in FIG. 4. The limiting plate 40 is formed of a thin film member made of synthetic resin or metal, and provided in such a manner that one of the planes thereof comes into contact with the developing roller 33 (see FIG. 4). The limiting plate 40 thus forms a toner thin layer on the peripheral surface of the developing roller 33, which makes it possible to supply toner particles to the photoconductive drum 21 quantitatively.

A sealing member 41 is provided on the inner side of the developing portion 36 at each end of the developing roller 33 in the shaft axis direction. One sealing member 41 is provided to a point at each end of the developing roller 33 in the shaft axis direction. The sealing members 41 are made of felt, urethane, sponge, non-woven cloth, and the like, and provided so as to come into contact with the surface of the developing roller 33 about halfway around the developing roller 33 along the peripheral surface thereof. The sealing members 41 play a role to prevent toner particles from leaking to the outside through clearances between the both ends of the developing roller 33 in the shaft axis direction and the developing containers 34.

Figure 5:
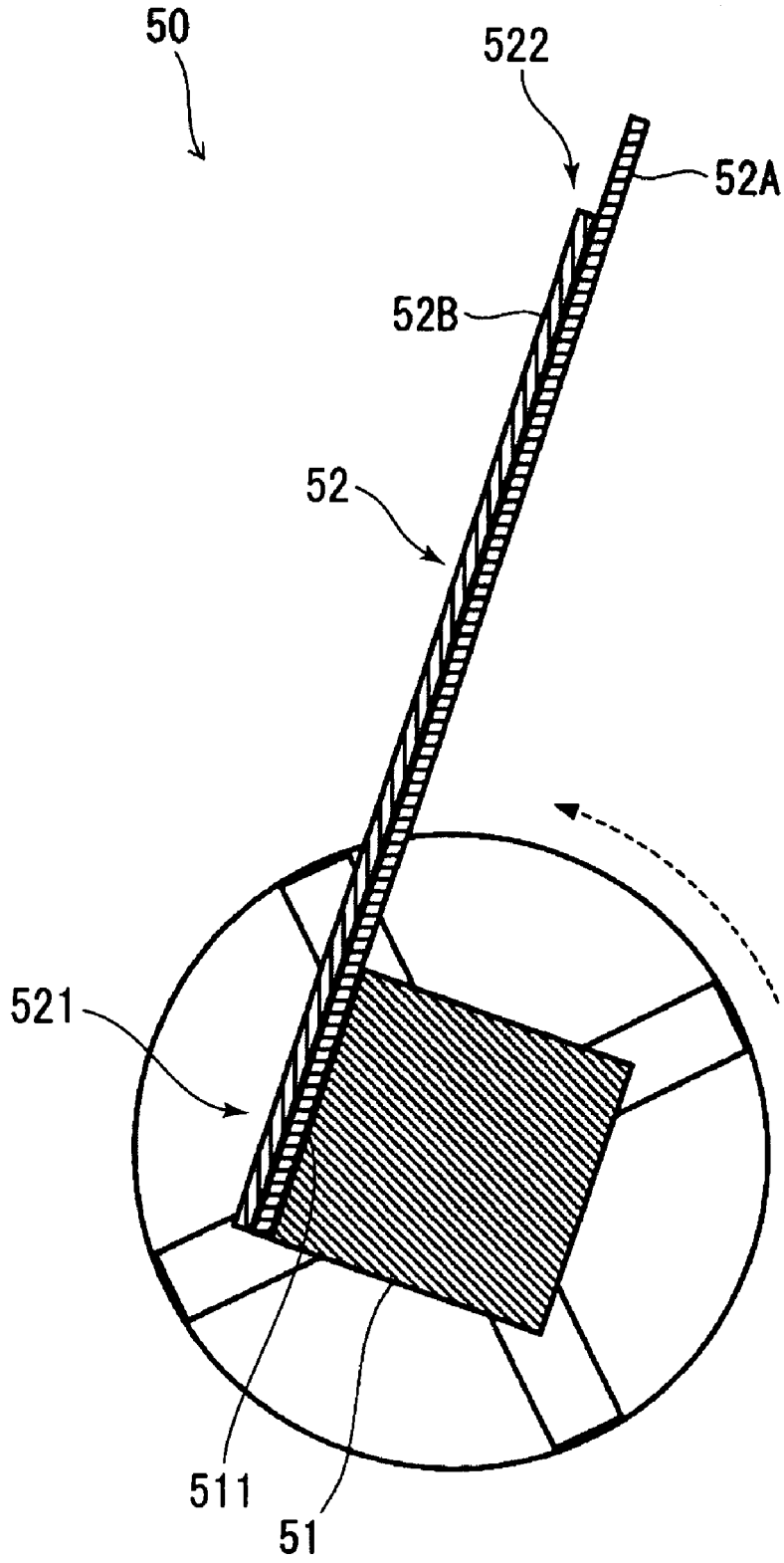
FIG. 5 is a lateral cross section of a stirring and transporting member in the developer shown in FIG. 4.
Figure 6:
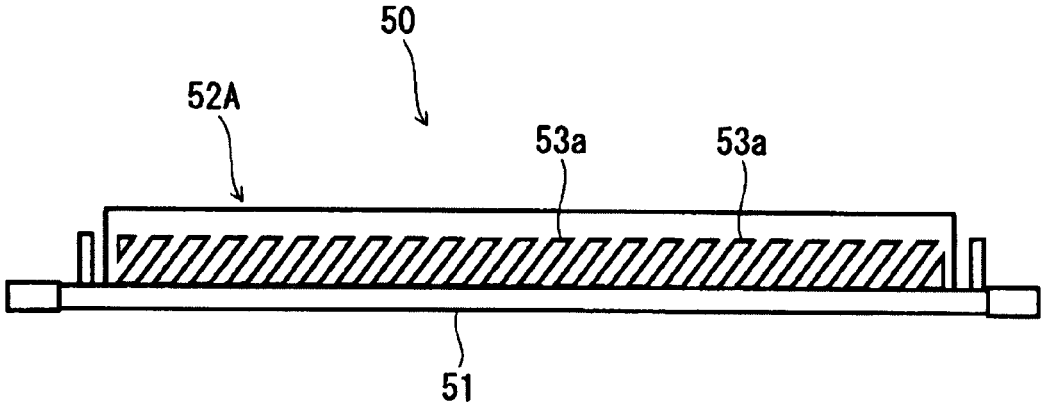
FIG. 6 is a front view of the stirring and transporting member shown in FIG. 5.
Figure 7:
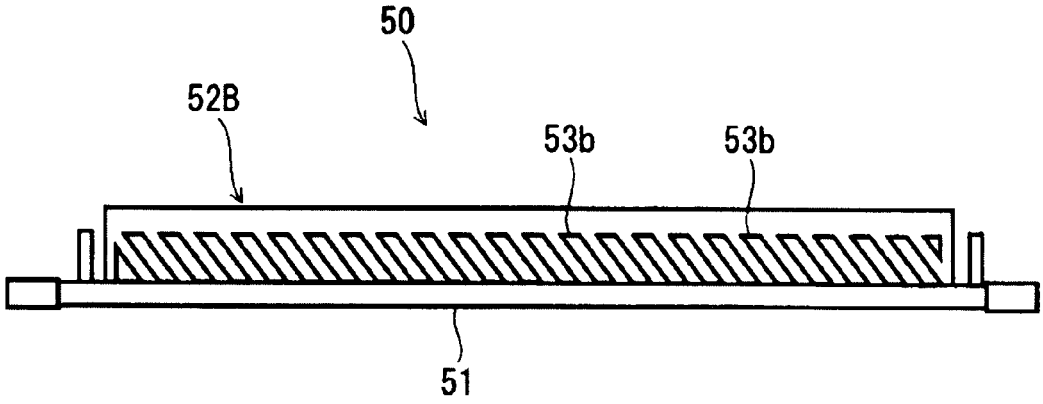
FIG. 7 is a front view of the stirring and transporting member with a stirring blade having an opening pattern different from the opening pattern of FIG. 6.

The configuration of the stirring and transporting member 50 disposed in the hopper portion 35 will now be described in detail using FIG. 5 through FIG. 7 in addition to FIG. 4. FIG. 5 is a lateral cross section of the stirring and transporting member. FIG. 6 is a front view of the stirring and transporting member. FIG. 7 is a front view of the stirring and transporting member same as the stirring and transporting member shown in FIG. 6 except that it has an opening pattern in stirring blades different from the opening pattern in FIG. 6.

As is shown in FIG. 5, the stirring and transporting member 50 includes a shaft portion 51 and a stirring blade 52.

The shaft portion 51 is in the shape of an elongate rectangular prism extending in the longitudinal direction of the developing container 34, that is, in the depth direction on the sheet surfaces of FIG. 4 and FIG. 5, and has a cross section almost in the shape of a square. The stirring and transporting member 50 rotates about the center shaft axis extending in the longitudinal direction of the shaft portion 51.

As is shown in FIG. 5, the stirring blade 52 is attached to a plane 511 of the rectangular prism forming the shaft portion 51 extending in the longitudinal direction of the developing container 34 on a fixed end side 521 thereof. The stirring blade 52 is formed of a sheet of PET (polyethylene terephthalate) film having a thickness of 125 μm, and fixed to the shaft portion 51 in a shape extending outward in the radius direction from the shaft portion 51 (the tip end side is referred to as the free end side 522). As is shown in FIG. 4, because an interval between the stirring and transporting member 50 and the inner wall of the developing container 34 is relatively narrow in part, the stirring blade 52 comes into contact with the inner wall of the developing container 34 at this narrow portion and moves with rotation while scarping the inner wall when the stirring and transporting member 50 rotates.

The stirring blade 52 is formed by combining two stirring blades, a first stirring blade 52A and a second stirring blade 52B, placed one on top of the other, and fixed to the shaft portion 51. As are shown in FIG. 6 and FIG. 7, the first and second stirring blades 52A and 52B are provided with plural openings 53*a* and 53*b*, respectively. These openings 53*a* and 53*b* are openings extending from the fixed end sides 521 of the first stirring blade 52A and the second stirring blade 52B fixed to the shaft portion 51 to the free end sides 522 (that is, extending from bottom to top in FIG. 6 and FIG. 7). It should be noted that the conformations of the openings 53*a* and 53*b* determine the toner transportation directions by the first stirring blade 52A and the second stirring blade 52B.

The openings 53*a* and 53*b* are made in a rectangular shape that is inclined with respect to an orthogonal axis orthogonal to the shaft axis (longitudinal direction axis) of the shaft portion 51 and passing over the first stirring blade 52A and the second stirring blade 52B. The first stirring blade 52A and the second stirring blade 52B have respective opening patterns that are determined by the inclined directions of the plural openings 53*a* and 53*b*. The opening patterns are different between the first stirring blade 52A and the second stirring blade 52B. They are made different in order to let the first stirring blade 52A transport toner particles in a first transportation direction along the shaft axis of the shaft portion 51 and to let the second stirring blade 52B transport toner particles in a second transportation direction opposite to the first transportation direction.

To be more concrete, as is shown in FIG. 6, all the plural openings 53*a* made in the first stirring blade 52A are inclined toward one end of the shaft portion 51, that is, rightward, from the fixed end side (the bottom in FIG. 6). In other words, the first stirring blade 52A has an opening pattern in which all the openings 53*a* are inclined to one side of the orthogonal axis. Accordingly, when the first stirring blade 52A rotates in association with rotations of the shaft portion 51, toner particles are migrated from left to right (first transportation direction) along the inclination of the openings 53*a*.

On the contrary, as is shown in FIG. 7, all the plural openings 53*b* made in the second stirring blade 52B are inclined to the other end of the shaft portion 51, that is, leftward, form the fixed end side (the bottom in FIG. 7). In other words, the second stirring blade 52B has an opening pattern in which all the openings 53*b* are inclined to the other side of the orthogonal axis. Accordingly, when the second stirring blade 52B rotates in association with rotations of the shaft portion 51, toner particles are migrated from right to left (second transportation direction) along the inclination of the openings 53*b*. The stirring and transporting member 50 includes one first stirring blade 52A and one second stirring blade 52B provided with the openings 53*a* and 53*b*, respectively, that are made in two types of opening patterns.

As is shown in FIG. 5, the first stirring blade 52A and the second stirring blade 52B have different lengths in the radius direction. To be more specific, the first stirring blade 52A disposed upstream in the rotation direction of the stirring and transporting member 50 has a longer length in the radius direction than the second stirring blade 52B disposed downstream. It should be appreciated, however, that the first stirring blade 52A and the second stirring blade 52B may be disposed at replaced positions as long as they are configured in such a manner that the one disposed upstream in the rotation direction has a longer length in the radius direction than the other one disposed downstream.

According to the developing device 30 of the first embodiment configured as above, the stirring and transporting member 50 is formed by placing the first stirring blade 52A and the second stirring blade 52B one on top of the other, and the first stirring blade 52A and the second stirring blade 52B have transportation directions different from each other. Toner particles are therefore allowed to migrate in various directions, for example, toward the both ends or toward the center in the longitudinal direction inside the developing container 34, owing to the functions of the respective stirring blades 52A and 52B.

It thus becomes possible to prevent toner particles from accumulating at the both ends or the center in the longitudinal direction inside the developing container 34, which in turn makes it possible to stir toner particles homogeneously as a whole. Accordingly, even when toner particles are replenished to the developing container 34 locally, the toner particles can be distributed homogeneously to a satisfactory extent in the longitudinal direction inside the developing container 34. It is therefore possible to obtain the developing device 30 capable of forming a high-quality image by preventing the occurrence of an image defect resulting from accumulated toner particles in a deteriorated condition.

In addition, the first stirring blade 52A and the second stirring blade 52B are configured in such a manner that they have the plural openings 53*a* and 53*b*, respectively, inclined from the fixed end side 521 to the free end side 522 (see FIG. 5), and that the inclined direction of the openings 53*a* made in the first stirring blade 52A and the inclined direction of the openings 53*b* made in the second stirring blade 52B are different.

Hence, by rotating the respective stirring blades 52A and 52B, it is possible to allow toner particles to migrate along the respective inclined directions of the openings 53*a* and 53*b*. This allows the toner particles to migrate in various directions, for example, toward the both ends or toward the center in the longitudinal direction inside the developing container 34 with ease. It is therefore possible to distribute toner particles homogeneously to a satisfactory extent in the longitudinal direction of the developing container 34 efficiently.

Further, all the plural openings 53*a* made in the first stirring blade 52A are inclined rightward with respect to the orthogonal axis orthogonal to the shaft axis of the shaft portion 51 and passing over the first stirring blade 52A, and all the plural openings 53*b* made in the second stirring blade 52B are inclined leftward with respect to the orthogonal axis orthogonal to the shaft axis of the shaft portion 51 and passing over the second stirring blade 52B.

It is thus possible to allow toner particles to migrate to one end in the longitudinal direction inside the developing container 34 by the first stirring blade 52A while allowing toner particles to migrate to the other end by the second stirring blade 52B. Toner particles are consequently allowed to migrate in both directions from one end to the other in the longitudinal direction inside the developing container 34, which makes it possible to stir toner particles efficiently. It is thus possible to enhance the function of distributing toner particles homogeneously in the longitudinal direction inside the developing container 34.

Further, the stirring and transporting member 50 is formed by placing the first and second stirring blades 52A and 52B one on top of the other. The first and second stirring blades 52A and 52B therefore stir toner particles by moving with rotation continuously at short time intervals. This increases a stirring force in comparison with a case where the stirring blades are not placed one on top of the other, and toner particles are allowed to migrate more easily along the longitudinal direction inside the developing container 34. It is thus possible to further enhance the function of distributing toner particles homogeneously in the longitudinal direction inside the developing container 34.

In a case where the first and second stirring blades 52A and 52B are placed one on top of the other, because the second stirring blade 52B disposed downstream in the rotation direction thereby coming into contact with toner particles first has a stronger stirring force, a larger amount of toner particles are migrated by the second stirring blade 52B. Hence, in this embodiment, the stirring and transporting member 50 having the first and second stirring blades 52A and 52B placed one on top of the other is correspondingly configured in such a manner that the first stirring blade 52A disposed at the uppermost stream end in the rotation direction has a longer length in the radius direction than the second stirring blade 52B disposed adjacently immediately downstream.

This configuration gives rise to a difference in load applied to the first stirring blade 52A disposed upstream and the second stirring blade 52B disposed downstream, which increases an interval between the two stirring blades 52A and 52B placed one on top of the other. Consequently, amounts of toner particles migrated by the two stirring blades 52A and 52B placed one on top of the other become almost equal. Hence, because the ability to stir toner particles effectively is enhanced, toner particles are allowed to migrate more easily. It is thus possible to further enhance the function of distributing toner particles homogeneously in the longitudinal direction inside the developing container 34.

Further, when toner particles inside the developing container 34 are allowed to migrate smoothly by the stirring and transporting member 50 configured as described above, there may be a case where toner particles migrate in and out between the developing portion 36 and the hopper portion 35 too actively. Nevertheless, in this embodiment, because the developing container 34 includes the partition wall 38 having the openings 38*a* between the developing portion 36 in which the developing roller 33 is disposed and the hopper portion 35 in which the stirring and transporting member 50 is disposed, it is possible to limit an amount of toner particles migrating between the developing portion 36 and the hopper portion 35. Hence, not only is it possible to distribute toner particles homogeneously to a satisfactory extent in the longitudinal direction inside the developing container 34, but it is also possible to transport toner particles suitably to the developing portion 36, which in turn enables an image to be formed at a higher quality.

Also, in this embodiment, because the developing device 30 is incorporated into the printer 1, even when toner particles are supplied to the developing container 34 of the developing device 30 locally, the toner particles can be distributed homogeneously to a satisfactory extent in the longitudinal direction inside the developing container 34. It is thus possible to obtain the high-performance printer 1 capable of forming a high-quality image.

Figure 8:
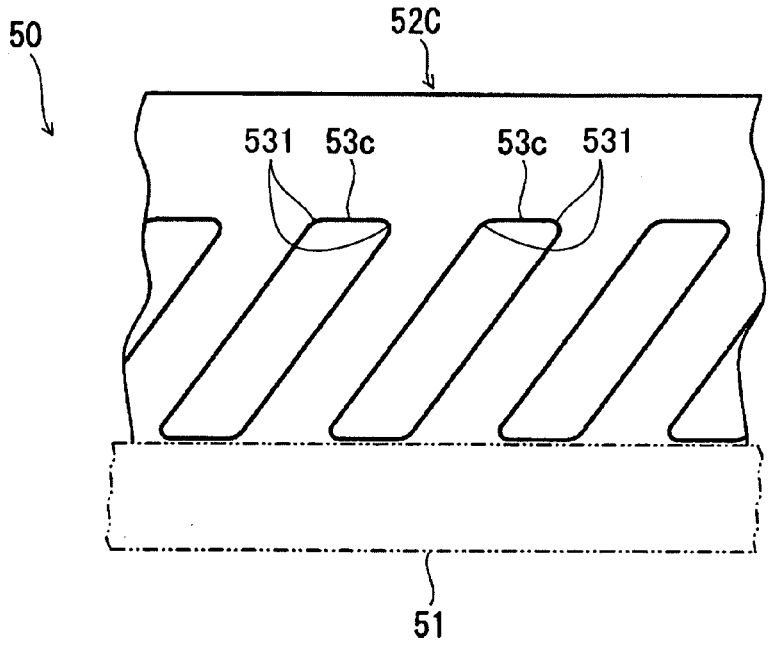
FIG. 8 is an enlarged front view of a stirring blade in a stirring and transporting member in a developing device according to a second embodiment of the invention.

A developing device according to a second embodiment of the invention will now be described in detail using FIG. 8. FIG. 8 is an enlarged front view of a stirring blade 52C of the stirring and transporting member 50 in the developing device. Because the basic configuration of this embodiment is the same as that of the first embodiment described above using FIG. 1 through FIG. 7, illustrations in the drawing and descriptions of the configuration common with the first embodiment are omitted herein (the same applies to third through seventh embodiments described below).

In the developing device of the second embodiment, the stirring and transporting member 50 includes at least one stirring blade 52C (first stirring blade) attached to the shaft portion 51, which is provided with plural openings 53*c* in the pattern shown in FIG. 8. The shaft portion 51 includes another stirring blade (second stirring blade, not shown) placed on the stirring blade 52C, which is provided with plural openings of the same shape as the openings 53*c* made in the stirring blade 52C in a pattern having a different inclined direction.

The openings 53*c* are of a rectangular shape similar to the openings 53*a* (see FIG. 6) made in the stirring blade 52A of the first embodiment. However, as is shown in FIG. 8, the corners 531 are rounded. It is possible to achieve the function and the effects same as those of the first embodiment with the stirring blade 52C provided with the openings 53*c* of the shape specified above.

Figure 9:
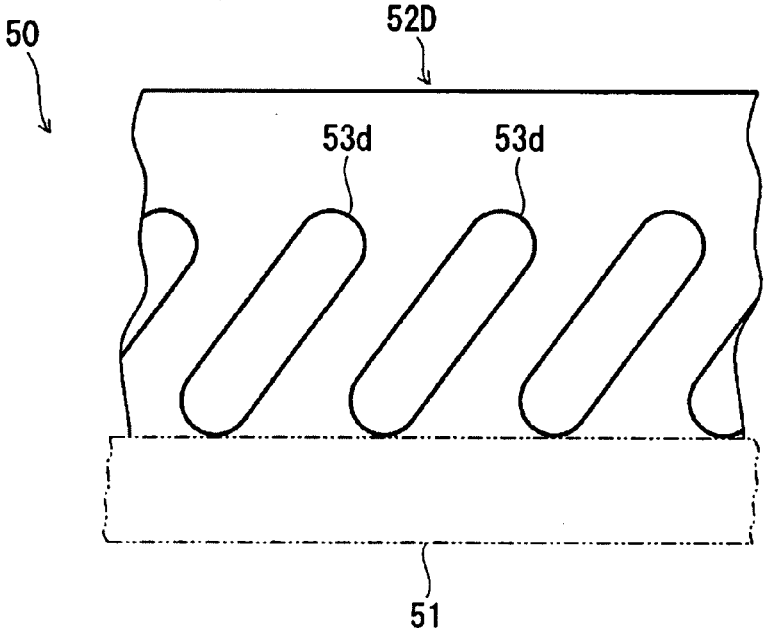
FIG. 9 is an enlarged front view of a stirring blade in a stirring and transporting member in a developing device according to a third embodiment of the invention.

A developing device according to a third embodiment of the invention will now be described in detail using FIG. 9. FIG. 9 is an enlarged front view of a stirring blade 52D of the stirring and transporting member 50 in the developing device. In the developing device of the third embodiment, the stirring and transporting member 50 includes at least one stirring blade 52D (first stirring blade) attached to the shaft portion 51, which is provided with plural openings 53*d* in the pattern shown in FIG. 9. The shaft portion 51 includes another stirring blade (second stirring blade, not shown) placed on the stirring blade 52D, which is provided with plural openings of the same shape as the openings 53*d* made in the stirring blade 52D in a pattern having a different inclined direction.

As is shown in FIG. 9, the openings 53*d* are of an oblong shape. It may be of so-called an oval shape opening including an elliptical shape opening and an egg-shaped opening. It is possible to achieve the function and the effects same as those of the first embodiment with the stirring blade 52D provided with the openings 53*d* of the shape specified above.

Figure 10:
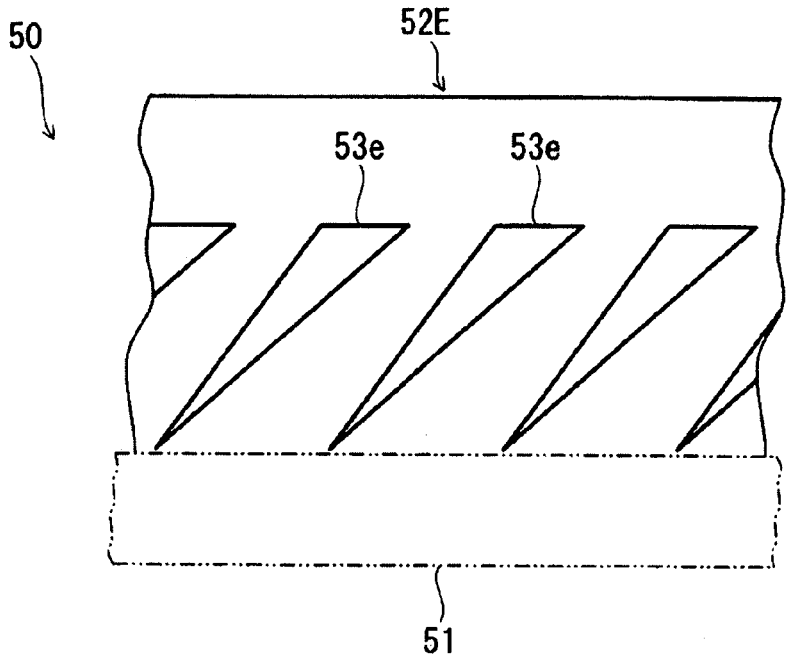
FIG. 10 is an enlarged front view of a stirring blade in a stirring and transporting member in a developing device according to a fourth embodiment of the invention.

A developing device according to a fourth embodiment of the invention will now be described in detail using FIG. 10. FIG. 10 is an enlarged front view of a stirring blade 52E of the stirring and transporting member 50 in the developing device. In the developing device of the fourth embodiment, the stirring and transporting member 50 includes at least one stirring blade 52E (first stirring blade) attached to the shaft portion 51, which is provided with plural openings 53*e* made in the pattern shown in FIG. 10. The shaft portion 51 includes another stirring blade (second stirring blade, not shown) placed on the stirring blade 52E, which is provided with plural openings of the same shape as the openings 53*e* made in the stirring blade 52E in a pattern having a different inclined direction.

As is shown in FIG. 10, the openings 53*e* are of a triangular shape. It is possible to achieve the function and the effects same as those of the first embodiment with the stirring blade 52E provided with the openings 53*e* of the shape specified above.

Figure 11:
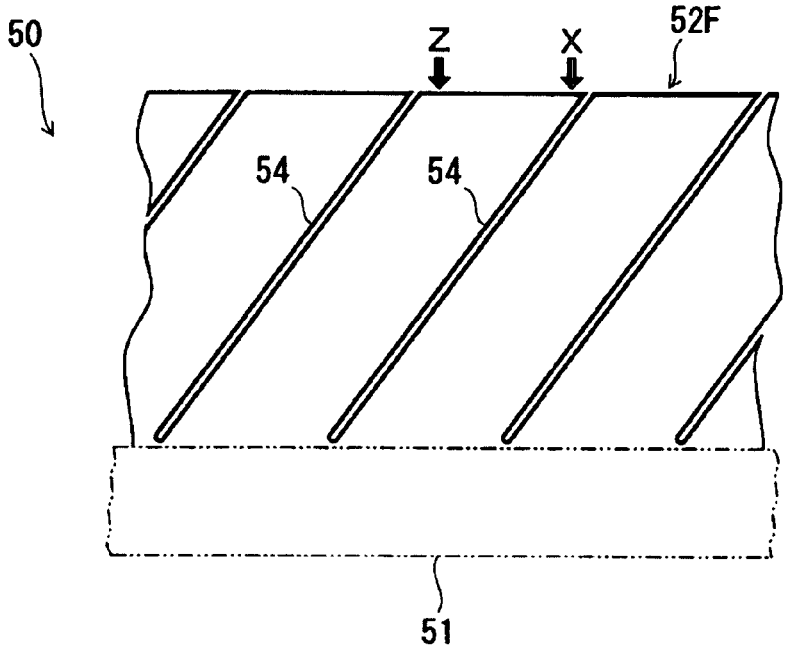
FIG. 11 is an enlarged front view of a stirring blade in a stirring and transporting member in a developing device according to a fifth embodiment of the invention.

A developing device according to a fifth embodiment of the invention will now be described in detail using FIG. 11. FIG. 11 is an enlarged front view of a stirring blade 52F of the stirring and transporting member 50 in the developing device. In the developing device of the fifth embodiment, the stirring and transporting member 50 includes a stirring blade 52F (first stirring blade) provided with plural slits 54 made in the pattern shown in FIG. 11 upstream in the rotation direction. Further, it includes another stirring blade (second stirring blade, not shown) disposed downstream of the stirring blade 52F in the rotation direction and placed thereon, which is provided with plural slits or plural openings of a shape different from the slits 54 made in the stirring blade 52F, for example, any of the shapes described in the first through fourth embodiments above in a pattern having a different inclination direction.

The slits 54 shown in FIG. 11 reach the free end of the stirring blade 52F, that is, the top end of the stirring blade 52F in FIG. 11. When the stirring and transporting member 50 provided with the stirring blade 52F having such slits 54 is rotated, a portion indicated by an arrow X in FIG. 11 rotates slower than a portion indicated by an arrow Z between adjacent slits 54 owing to the function of the inclined slits 54. Toner particles are thus allowed to migrate from left to right along the inclination of the slits 54. It is therefore possible to achieve the function and the effects same as those of the first embodiment with the stirring blade 52F provided with the slits 54.

Figure 12:
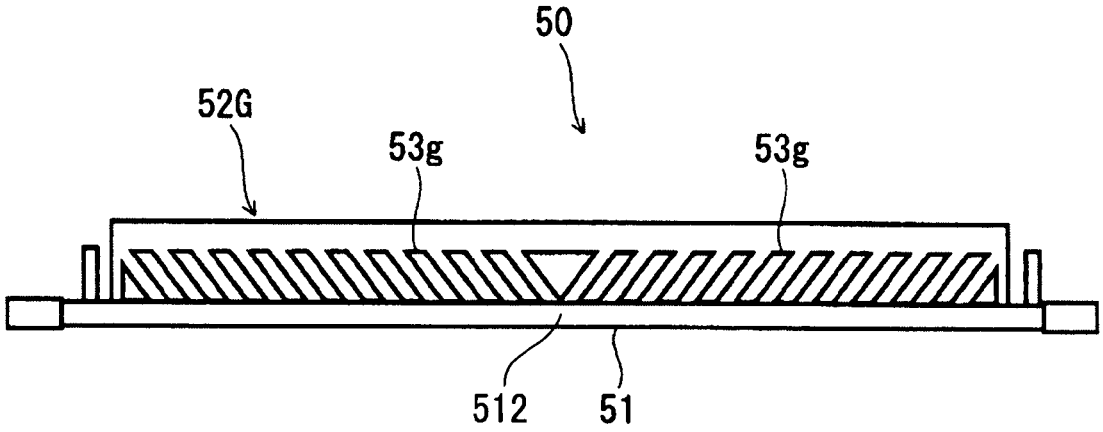
FIG. 12 is a front view of a stirring and transporting member in a developing device according to a sixth embodiment of the invention.
Figure 13:
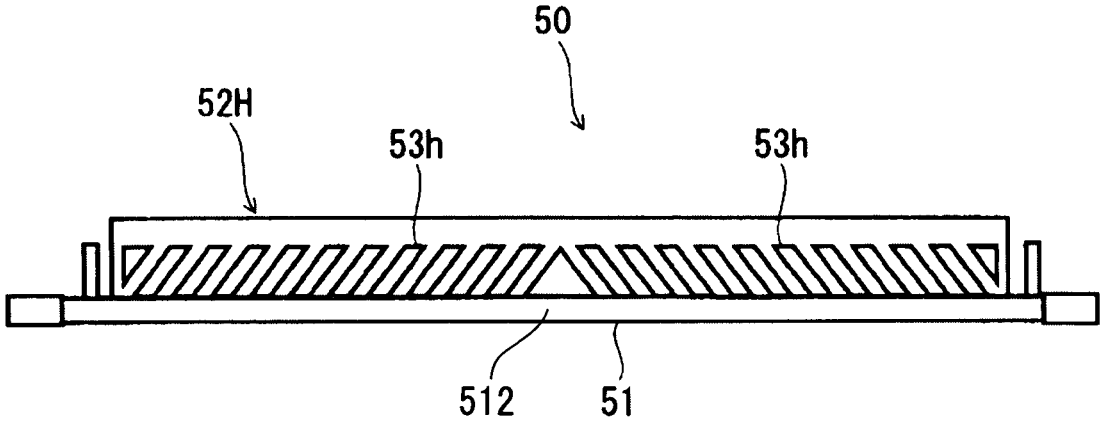
FIG. 13 is a front view of a stirring and transporting member with a stirring blade having an opening pattern different from the opening pattern of FIG. 12.

A developing device according to a sixth embodiment of the invention will now be described in detail using FIG. 12 and FIG. 13. FIG. 12 is a front view of a first stirring blade 52G of the stirring and transporting member 50 in the developing device. FIG. 13 is a front view of a second stirring blade 52H having an opening pattern different from the opening pattern shown in FIG. 12.

In the developing device of the sixth embodiment, the stirring and transporting member 50 includes the first stirring blade 52G and the second stirring blade 52H that are provided, respectively, with openings 53*g* and 53*h* in patterns having different inclined directions as are shown in FIG. 12 and FIG. 13, respectively, and it is formed by attaching these stirring blades placed one on top of the other to the shaft portion 51.

In this embodiment, the first stirring blade 52G and the second stirring blade 52H have opening patterns in which the inclined directions of the openings 53*g* and 53*h* are inverted at the center portion 512 in the shaft axis direction of the shaft portion 51. As is shown in FIG. 12, of the plural openings 53*g* made in the first stirring blade 52G, a left half of them from the center portion 512 in the shaft axis direction of the shaft portion 51 are inclined to an upper left direction from the fixed end (the bottom in FIG. 12), whereas a right half of them from the center portion 512 in the shaft axis direction are inclined to an upper right direction from the fixed end. Accordingly, when the first stirring blade 52G rotates in association with rotations of the shaft portion 51, toner particles migrate toward the both ends from the center portion 512 in the shaft axis direction along the inclination of the openings 53*g*.

Meanwhile, as is shown in FIG. 13, of the plural openings 53*h* made in the second stirring blade 52H, a left half of them from the center portion 512 in the shaft axis direction of the shaft portion 51 are inclined to an upper right direction from the fixed end (the bottom in FIG. 12), whereas a right half of them from the center portion 512 in the shaft axis direction are inclined to an upper left direction from the fixed end. Accordingly, when the second stirring blade 52H rotates in association with rotations of the shaft portion 51, toner particles migrate toward the center portion from the both ends in the shaft axis direction along the inclination of the openings 53*h*.

The stirring and transporting member 50 includes one stirring blade 52G and one stirring blade 52H provided with the openings 53*g* and 53*h*, respectively, that are made in two types of opening patterns.

According to this configuration, it is possible to allow toner particles to migrate toward the both ends in the longitudinal direction inside the developing container 34 by the first stirring blade 52G while allowing toner particles to migrate toward the center by the second stirring blade 52H. The toner particles are therefore allowed to migrate from the both ends to the center and from the center to the both ends inside the developing container 34, which in turn makes it possible to stir toner particles efficiently. It is thus possible to enhance the function of distributing toner particles homogeneously in the longitudinal direction inside the developing container 34.

Figure 14:
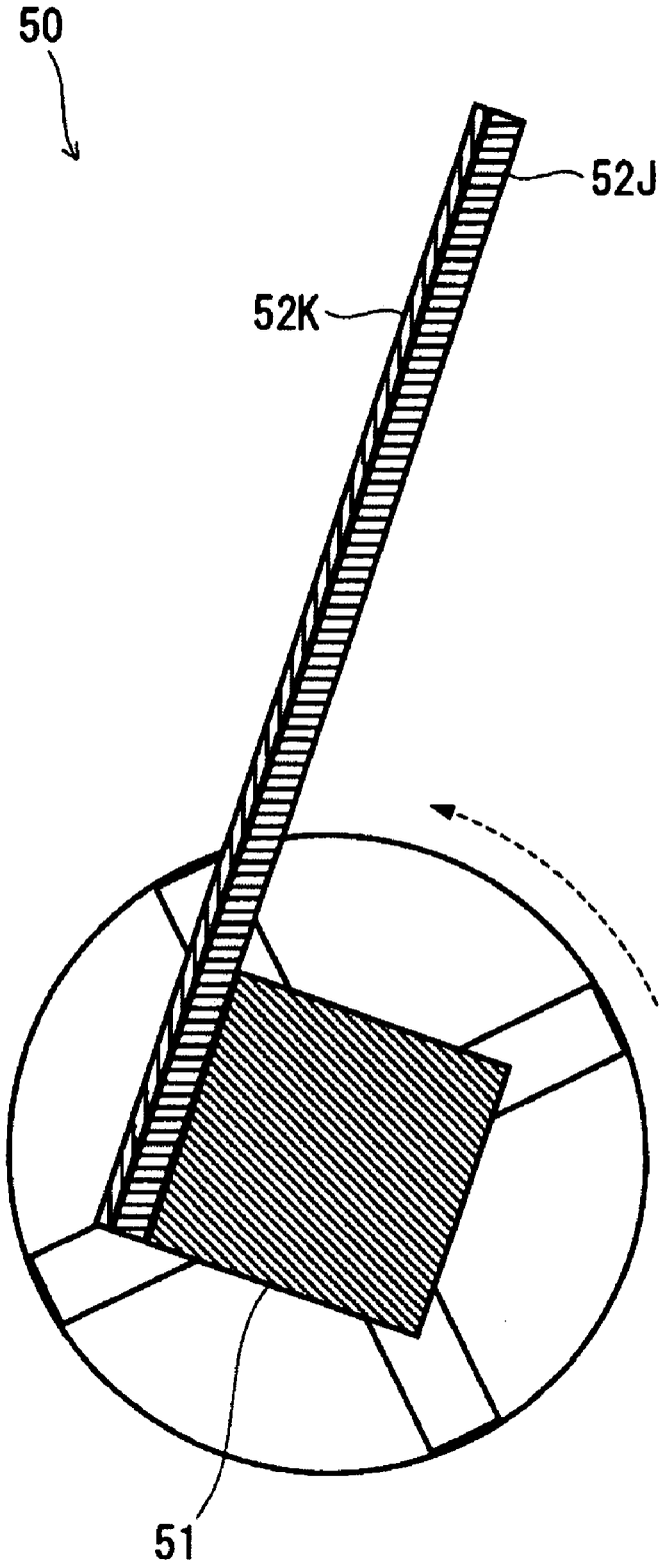
FIG. 14 is a lateral cross section of a stirring and transporting member in a developing device according to a seventh embodiment of the invention.

A developing device according to a seventh embodiment of the invention will now be described in detail using FIG. 14. FIG. 14 is a lateral cross section of the stirring and transporting member 50. In the developing device of the seventh embodiment, as is shown in FIG. 14, the stirring and transporting member 50 includes first and second stirring blades 52J and 52K that are placed one on top of the other and attached to the shaft portion 51, and the first and second stirring blades 52J and 52K have thicknesses different from each other. To be more specific, the first stirring blade 52J disposed upstream in the rotation direction of the stirring and transporting member 50 is thicker than the second stirring blade 52K disposed adjacently downstream.

The first stirring blade 52J disposed upstream therefore has a stronger elastic repulsive force than the second stirring blade 52K disposed downstream, and consequently has an increased stirring force. Hence, because the stirring forces of the two stirring blades 52J and 52K placed one on top of the other become almost equal to each other, the ability to stir toner particles effectively is further enhanced and toner particles are allowed to migrate more easily. It is thus possible to further enhance the function of distributing toner particles homogeneously in the longitudinal direction inside the developing container 34.

Opening patterns of the stirring blades 52J and 52K not shown in FIG. 14 can be any pattern of the openings 53*a* through 53*e*, 53*g*, and 53*h* or the slits 54 of the first through sixth embodiments above. It is preferable to form the pattern with a pair of the openings 53*a* and 53*b*, a pair of any of the openings 53*c* through 53*e* and openings having a different inclined direction from the inclined direction of the counterpart, a pair of the slits 54 and any one of the openings 53*a* through 53*e*, or a pair of the openings 53*g* and 53*h*.

While the invention has been described by way of embodiments, it should be appreciated that the invention is not limited to the embodiments above, and the invention can be modified in various manners without deviating from the scope of the invention.

For example, the printer 1 in the embodiments above was described as an image forming apparatus for color printing in which the developing device 30 includes the rotary rack 31 provided with the four developers 32 that are disposed at regular intervals in the circumferential direction and the endless intermediate transfer belt 10 is provided as the intermediate transfer body. However, the printer 1 may be a tandem image forming apparatus for color printing, or an image forming apparatus for monochrome printing using black toner particles alone without the need to use the intermediate transfer body.

Also, the embodiments above described a case where the first stirring blade 52A and the second stirring blade 52B placed one on top of the other are fixed to the shaft portion 51. However, the first stirring blade 52A and the second stirring blade 52B are not necessarily placed one on top of the other, and they may be fixed to the shaft portion 51 while being spaced apart from each other. For example, the first stirring blade 52A and the second stirring blade 52B may be attached to the shaft portion 51 at positions displaced by 90 degrees or 180 degrees in the circumferential direction of the shaft portion 51.

Further, the embodiments above described a case where two stirring blades (for example, the first stirring blade 52A and the second stirring blade 52B) are attached to the shaft portion 51. However, more than one pair of stirring blades having different transportation directions may be attached to the shaft portion 51.

The embodiments above described the developing device and the image forming apparatus by way of example. The invention, however, is also applicable, for example, to a toner container that supplies the developing device with toner particles. Further, the invention is also applicable to a container to accommodate appropriate powder, including various devices that stir or mix powder inside the container or various devices that discharge powder from a discharge port provided to a specific portion of the container while stirring the powder inside the container.

The specific embodiments described above chiefly include inventions having the following configurations.

A developing device according to an aspect of the invention includes: a developing container that accommodates toner particles; a developing roller that supplies the toner particles to an image carrier on which an electrostatic latent image is formed; and a stirring and transporting member that transports the toner particles inside the developing container toward the developing roller with stirring by rotating around a shaft axis, wherein the stirring and transporting member includes a shaft portion serving as a rotation center and sheet-shaped first stirring blade and second stirring blade fixed to the shaft portion so as to extend outward in a radius direction from the shaft portion, and the first stirring blade transports the toner particles in a first transportation direction and the second stirring blade transports the toner particles in a second transportation direction different from the first transportation direction.

According to this configuration, it is possible to allow toner particles to migrate in various directions, for example, toward the both ends or toward the center in the longitudinal direction inside the developing container owing to the functions of the first and second stirring blades. It is thus possible to prevent toner particles from accumulating at the both ends or the center in the longitudinal direction inside the developing container, which makes it possible to stir toner particles homogeneously as a whole. Accordingly, even when toner particles are supplied to the developing container locally, toner particles can be distributed homogeneously to a satisfactory extent in the longitudinal direction inside the developing container. It is thus possible to obtain a developing device or an image forming apparatus capable of forming a high-quality image by preventing the occurrence of an image defect resulting from accumulated toner particles in a deteriorated condition.

In the configuration described above, it is preferable that each of the first stirring blade and the second stirring blade has plural openings, and that a conformation of the openings in each blade determines a transportation direction of the toner particles by each blade. According to this configuration, it is possible to determine the transportation direction of toner particles by a process as simple as providing openings.

In this case, it is preferable that: the openings are openings extending from fixed ends of the first stirring blade and the second stirring blade fixed to the shaft portion to free ends; the openings are inclined with respect to an orthogonal axis that is orthogonal to the shaft axis of the shaft portion and passes over each blade; and the first stirring blade and the second stirring blade have opening patterns determined by inclined directions of the plural openings and the opening patterns are different between the first stirring blade and the second stirring blade.

According to this configuration, by rotating the respective stirring blades, it is possible to allow toner particles to migrate along the inclined directions of the openings. Toner particles are therefore allowed to migrate in various directions, for example, toward the both ends or toward the center in the longitudinal direction inside the developing container. It is thus possible to distribute toner particles homogenously to a satisfactory extent in the longitudinal direction inside the developing container efficiently.

In the configurations described above, it is preferable that the first stirring blade has an opening pattern in which the plural openings are inclined to one side of the orthogonal axis, and that the second stirring blade has an opening pattern in which the plural openings are inclined to the other side of the orthogonal axis.

According to this configuration, it is possible to allow toner particles to migrate toward one end in the longitudinal direction inside the developing container by the first stirring blade and to allow toner particles to migrate toward the other end by the second stirring blade. Toner particles are therefore allowed to migrate in both directions from one end to the other end in the longitudinal direction inside the developing container, which makes it possible to stir toner particles efficiently. It is thus possible to enhance the function of distributing toner particles homogeneously in the longitudinal direction inside the developing container.

In the configurations described above, it is preferable that: the first stirring blade and the second stirring blade have opening patterns in which inclined directions of the openings are inverted at a center portion in a shaft axis direction of the shaft portion; the first stirring blade transports the toner particles toward both ends from the center portion in the shaft axis direction of the shaft portion; and the second stirring blade transports the toner particles toward the center portion from the both ends in the shaft axis direction of the shaft portion.

According to this configuration, it is possible to allow toner particles to migrate toward the both ends in the longitudinal direction inside the developing container by the first stirring blade and to allow toner particles to migrate toward the center by the second stirring blade. Toner particles are therefore allowed to migrate from the both ends to the center and from the center to the both ends inside the developing container, which makes it possible to stir toner particles efficiently. It is thus possible to enhance the function of distributing toner particles homogeneously in the longitudinal direction inside the developing container.

In the configurations described above, a plane shape of the openings may be one of a rectangle and a rectangle with round corners. Alternatively, the plane shape of the openings may be an oval or a triangle.

In the configurations described above, it may be configured in such a manner that each of the first stirring blade and the second stirring blade has plural slits, and that a conformation of the slits in each blade determines a transportation direction of the toner particles by each blade.

In this case, it is preferable that: the slits are slits extending from fixed ends of the first stirring blade and the second stirring blade fixed to the shaft portion to free ends; the slits are inclined with respect to an orthogonal axis that is orthogonal to the shaft axis of the shaft portion and passes over each blade; and the first stirring blade and the second stirring blade have slit patterns determined by inclined directions of the plural slits and the slit patterns are different between the first stirring blade and the second stirring blade.

In the configurations described above, it is preferable that the first stirring blade and the second stirring blade are fixed to the shaft portion while being placed one on top of the other.

According to this configuration, the first and second stirring blades stir toner particles by moving with rotation continuously at short time intervals. This increases a stirring force in comparison with a case where the stirring blades are not placed one on top of the other, and toner particles are allowed to migrate more easily along the longitudinal direction inside the developing container. It is thus possible to further enhance the function of distributing toner particles homogeneously in the longitudinal direction inside the developing container.

In the configurations described above, it is preferable that the first stirring blade is disposed upstream in a rotation direction of the stirring and transporting member and the second stirring blade is disposed adjacently downstream in the rotation direction, and that the first stirring blade has a longer length in the radius direction than the second stirring blade.

According to this configuration, a difference is generated between loads applied to the first stirring blade disposed upstream and the second stirring blade disposed downstream, which increases an interval between the two stirring blades placed one on top of the other. Consequently, amounts of toner particles allowed to migrate by the two stirring blades placed one on top of the other become almost equal. Hence, because the ability to stir toner particles effectively is enhanced, toner particles are allowed to migrate more easily. It is thus possible to further enhance the function of distributing toner particles homogeneously in the longitudinal direction inside the developing container.

In the configurations described above, it is preferable that the first stirring blade is disposed upstream in a rotation direction of the stirring and transporting member and the second stirring blade is disposed adjacently downstream in the rotation direction, and that the first stirring blade is thicker than the second stirring blade.

According to this configuration, the first stirring blade disposed upstream has a stronger elastic repulsive force than the second stirring blade disposed downstream, and consequently has an increased stirring force. Hence, because the stirring forces of the two stirring blades placed one on top of the other become almost equal to each other, the ability to stir toner particles effectively is enhanced and toner particles are allowed to migrate more easily. It is thus possible to further enhance the function of distributing toner particles homogeneously in the longitudinal direction inside the developing container.

In the configurations described above, it is preferable that the developing container includes: a developing portion in which the developing roller is disposed; a hopper portion in which the stirring and transporting member is disposed; and a partition wall disposed between the developing portion and the hopper portion and provided with openings.

When toner particles inside the developing container are allowed to migrate smoothly by the stirring and transporting member provided with the stirring blades configured as described above, there may be a case where toner particles migrate in and out between the developing portion and the hopper portion too actively. However, according to this configuration, because the developing container includes the partition wall having the openings, it is possible to limit an amount of toner particles migrating between the developing portion and the hopper portion. Hence, not only is it possible to distribute toner particles homogeneously to a satisfactory extent in the longitudinal direction inside the developing container, but it is also possible to transport toner particles suitably to the developing portion, which in turn enables an image to be formed at a higher quality.

An image forming apparatus according to another aspect of the invention includes: an image carrier on which an electrostatic latent image is formed, and a developing device that supplies toner particles to the image carrier, wherein: the developing device includes a developing container that accommodates the toner particles, a developing roller that supplies the toner particles to the image carrier on which the electrostatic latent image is formed, and a stirring and transporting member that transports the toner particles inside the developing container toward the developing roller with stirring by rotating around a shaft axis; the stirring and transporting member includes a shaft portion serving as a rotation center and sheet-shaped first stirring blade and second stirring blade fixed to the shaft portion so as to extend outward in a radius direction from the shaft portion; and the first stirring blade transports the toner particles in a first transportation direction and the second stirring blade transports the toner particles in a second transportation direction different from the first transportation direction.

According to this configuration, because the developing device is incorporated into the image forming apparatus, even when toner particles are replenished to the developing container locally, toner particles can be distributed homogeneously to a satisfactory extent in the longitudinal direction inside the developing container. It is thus possible to obtain a high-performance image forming apparatus capable of forming a high-quality image.

A powder stirring device according to still another aspect of the invention includes a container that accommodates powder, and a stirring and transporting member that transports the powder inside the container with stirring by rotating about a shaft center, wherein the stirring and transporting member includes a shaft portion serving as a rotation center and sheet-shaped first stirring blade and second stirring blade fixed to the shaft portion so as to extend outward in a radius direction from the shaft portion, and the first stirring blade transports the powder in a first transportation direction and the second stirring blade transports the powder in a second transportation direction different from the first transportation direction.

This application is based on patent application No. 2006-269227 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A powder stirring device comprising:

a container that accommodates powder;

a stirring and transporting member that transports the powder inside the container with stirring by rotating about a shaft center, wherein:

the stirring and transporting member includes a shaft portion serving as a rotation center and sheet-shaped first stirring blade and second stirring blade fixed to the shaft portion so as to extend outward in a radius direction from the shaft portion; and the first stirring blade transports the powder in a first transportation direction and the second stirring blade transports the powder in a second transportation direction different from the first transportation direction each of the first stirring blade and the second stirring blade has plural slits; and a conformation of the slits in each blade determines a transportation direction of the powder by each blade.

2. The powder stirring device according to claim 1, wherein the slits are slits extending from fixed ends of the first stirring blade and the second stirring blade fixed to the shaft portion to free ends;

the slits are inclined with respect to an orthogonal axis that is orthogonal to the shaft axis of the shaft portion and passes over each blade; and the first stirring blade and the second stirring blade have slit patterns determined by inclined directions of the plural slits and the slit patterns are different between the first stirring blade and the second stirring blade.

3. The powder stirring device according to claim 1, wherein:

the powder is toner particles, and the powder stirring device further comprises a developing roller that supplies the toner particles to an image carrier on which an electrostatic latent image is formed, the container being a developing container which accommodates the toner particles, and the stirring and transporting member transporting the toner particles toward the developing roller while stirring the toner particles inside the developing container.

4. The powder stirring device according to claim 1, wherein:

the powder is toner particles, and the powder stirring device further comprises:

an image carrier on which an electrostatic latent image is formed; and a developing roller that supplies the toner particles to the image carrier on which the electrostatic latent image is formed, the container being a developing container that accommodates the toner particles, and the stirring and transporting member transporting the toner particles toward the developing roller while stirring the toner particles inside the developing container.

5. A powder stirring device comprising:

a container that accommodates powder;

a stirring and transporting member that transports the powder inside the container with stirring by rotating about a shaft center, wherein:

the stirring and transporting member includes a shaft portion serving as a rotation center and sheet-shaped first stirring blade and second stirring blade fixed to the shaft portion so as to extend outward in a radius direction from the shaft portion; and the first stirring blade transports the powder in a first transportation direction and the second stirring blade transports the powder in a second transportation direction different from the first transportation direction the first stirring blade and the second stirring blade are fixed to the shaft portion while being placed one on top of the other.

6. The powder stirring device according to claim 5, wherein:

the first stirring blade is disposed upstream in a rotation direction of the stirring and transporting member and the second stirring blade is disposed adjacently downstream in the rotation direction; and the first stirring blade has a longer length in the radius direction than the second stirring blade.

7. The powder stirring device according to claim 5, wherein:

the first stirring blade is disposed upstream in a rotation direction of the stirring and transporting member and the second stirring blade is disposed adjacently downstream in the rotation direction; and the first stirring blade is thicker than the second stirring blade.

8. The powder stirring device according to claim 5, wherein:

the powder is toner particles, and the powder stirring device further comprises a developing roller that supplies the toner particles to an image carrier on which an electrostatic latent image is formed, the container being a developing container that accommodates the toner particles, and the stirring and transporting member transporting the toner particles toward the developing roller while stirring the toner particles inside the developing container.

9. The powder stirring device according to claim 5, wherein the powder is toner particles, and the powder stirring device further comprises:

an image carrier on which an electrostatic latent mage is formed; and a developing roller that supplies the toner particles to the image carrier on which the electrostatic latent image is formed, the container being a developing container that accommodates the toner particles, and the stirring and transporting member transporting the toner particles toward the developing roller while stirring the toner particles inside the developing container.

10. A powder stirring device, comprising:

a container that accommodates powder;

a stirring and transporting member that transports the powder inside the container with stirring by rotating about a shaft center, wherein:

the stirring and transporting member includes a shaft portion serving as a rotation center and sheet-shaped first stirring blade and second stirring blade fixed to the shaft portion so as to extend outward in a radius direction from the shaft portion; and the first stirring blade transports the powder in a first transportation direction and the second stirring blade transports the powder in a second transportation direction different from the first transportation direction.

each of the first stirring blade and the second stirring blade has plural openings, a conformation of the openings in each blade determines the transportation direction of the powder by each blade, the openings are openings extending from fixed ends of the first stirring blade and the second stirring blade fixed to the shaft portion to free ends, the openings are inclined with respect to an orthogonal axis that is orthogonal to the shaft axis of the shaft portion and passes over each blade, and the first stirring blade and the second stirring blade have opening patterns determined by inclined directions of the plural openings and the opening patterns are different between the first stirring blade and the second stirring blade.

11. The powder stirring device according to claim 10, wherein:

the first stirring blade has an opening pattern in which the plural openings are inclined to one side of the orthogonal axis; and the second stirring blade has an opening pattern in which the plural openings are inclined to the other side of the orthogonal axis.

12. The powder stirring device according to claim 10, wherein:

the first stirring blade and the second stirring blade have opening patterns in which inclined directions of the openings are inverted at a center portion in a shaft axis direction of the shaft portion;

the first stirring blade transports the power toward both ends from the center portion in the shaft axis direction of the shaft portion; and the second stirring blade transports the power toward the center portion from the both ends in the shaft axis direction of the shaft portion.

13. The powder stirring device according to claim 10, wherein:

a plane shape of the openings is one of a rectangle and a rectangle with round corners.

14. The powder stirring device according to claim 10, wherein:

a plane shape of the openings is an oval.

15. The powder stirring device according to claim 10, wherein:

a plane shape of the openings is a triangle.

16. The powder stirring device according to claim 10, wherein the powder is toner particles, and the powder stirring device further comprises:

a developing roller that supplies the toner particles to an image carrier on which an electrostatic latent image is formed, the container being a developing container that accommodates the toner particles, and the stirring and transporting member transporting the toner particles toward the developing roller while stirring the toner particles inside the developing container.

17. The powder stirring device according to claim 10, wherein the powder is toner particles, and the powder stirring device further comprises:

an image carrier on which an electrostatic latent mage is formed; and a developing roller that supplies the toner particles to the image carrier on which the electrostatic latent image is formed, the container being a developing container that accommodates the toner particles, and the stirring and transporting member transporting the toner particles toward the developing roller while stirring the toner particles inside the developing container.

* * * * *